United States Patent [19]

Rogers

[11] 4,027,885

[45] June 7, 1977

[54] GOLF IRON MANUFACTURE

[76] Inventor: Kenneth A. Rogers, 13520 Victory Blvd., Van Nuys, Calif. 90401

[22] Filed: July 19, 1976

[21] Appl. No.: 706,648

Related U.S. Application Data

[62] Division of Ser. No. 476,851, June 6, 1974, Pat. No. 3,970,236.

[52] U.S. Cl. ..... 273/169; 273/173; 273/167 F

[51] Int. Cl.[2] ..... A63B 53/04

[58] Field of Search ..... 273/77 R, 77 A, 78, 273/167–175

[56] References Cited

UNITED STATES PATENTS

| | | | |
|---|---|---|---|
| 863,728 | 8/1907 | Legh | 273/169 |
| 1,318,325 | 10/1919 | Klin | 273/171 |
| 1,529,009 | 3/1929 | Carpenter | 273/169 |
| 1,543,691 | 6/1925 | Beat | 273/167 F X |
| 1,720,867 | 7/1929 | Webster et al. | 273/169 |
| 1,968,092 | 7/1934 | Oldham | 273/169 |
| 1,968,627 | 7/1934 | Young | 273/169 |
| 1,988,043 | 1/1935 | Lard | 273/169 |
| 2,034,936 | 3/1936 | Barnhart | 273/78 |
| 2,254,528 | 9/1941 | Hoare | 273/167 F X |
| 2,332,342 | 10/1943 | Reach | 273/171 |
| 2,447,967 | 8/1948 | Stone | 273/77 A |
| 2,781,197 | 2/1957 | Wiley | 273/169 X |
| 2,846,228 | 8/1958 | Reach | 273/167 F |
| 2,931,098 | 4/1960 | Johnson | 273/167 R |
| 3,084,940 | 4/1963 | Cissel | 273/173 |
| 3,250,536 | 5/1966 | Moser | 273/167 F X |
| 3,356,782 | 12/1967 | Whyte | 273/171 X |
| 3,578,332 | 5/1971 | Caldwell | 273/78 |
| 3,652,093 | 3/1972 | Reuter | 273/167 J |
| 3,749,408 | 7/1973 | Mills | 273/171 |
| 3,834,700 | 9/1974 | Averbach | 273/167 F |

FOREIGN PATENTS OR APPLICATIONS

| | | | |
|---|---|---|---|
| 4,516 | 3/1894 | United Kingdom | 273/167 F |
| 19,242 | 9/1902 | United Kingdom | 273/78 |

*Primary Examiner*—Richard J. Apley
*Attorney, Agent, or Firm*—Fulwider, Patton, Rieber, Lee & Utecht

[57] ABSTRACT

There is disclosed a construction of golf clubs of the iron type having the capability of imparting better loft and directional stability to golf balls. This capability results from the manufacture of the golf irons with desirably low centers of gravity and a generally symmetrical weight distribution about the striking face. The method of manufacture comprises casting a head having a hozel, neck and body dependent thereon and providing the body with an open cavity in its face that extends from at least one edge thereof across a substantial portion of the face and to a first depth therein. Faceplate land grooves are formed along opposite edges of the cavity. A sheet metal plate having a thickness approximately equal to the depth of these grooves is formed with exterior dimensions to seat in the opposite land grooves of the cavity and is placed in the land grooves thereby closing the face to the cavity. The sheet metal plate is secured about its periphery to the head to form an interior cavity open along an edge surface, preferably the top edge, extending across a substantial area of the face of the head. Preferably, the plate is fused to the head by an electron fusion step to produce a homogenous head having an internal cavity. The internal cavity of the head is filled with a low density filler such as an epoxy resin and the like and there is positioned along the bottom of the cavity a predetermined amount of high density weights of lead and the like, sufficient to impart the desired swing weight characteristic to the golf iron formed with the head.

8 Claims, 5 Drawing Figures

GOLF IRON MANUFACTURE

This is a division of application Ser. No. 476,851, filed June 6, 1974, now U.S. Pat. No. 3,970,236.

BACKGROUND OF THE INVENTION

1. Field of the Invention

This invention relates to golf clubs of the iron type and, in particular, to of a golf iron having an improved weight distribution.

2. Description of the Prior Art

Golf irons are commonly manufactured as solid metal castings having the approximate weight and the shape desired for the numbered catagory of the iron. The irons are commonly grouped into numbered catagories from one to nine with the lowest numbered iron having the longest shaft, the flattest or most vertical face and the lightest head weight. As the catagory number increases, the face becomes more inclined from the vertical, the shaft shortens about one-half inch and the weight of the club head increases by about seven grams for each number change. Golf irons also include specialty irons such as a sandwedge and the like which have a striking face which is generally at a greater angle from the vertical than even the highest numbered iron.

Golf irons are also manufactured with varied moment arms about a point twelve inches from the upper end of the club shaft. These moment arms, commonly referred to as swing weights are grouped in classes designated from C to F and in numbered series from one to ten within each class. This variation in the swing weight of the clubs is desirable to permit each player to select precisely the set of the clubs having the best swing weight for his size, strength and golfing skill.

In the conventional manufacture, the heads of the irons are formed as a solid body with a neck and dependent hozel for insertion of the club shaft. The desired swing weight is obtained by loading a predetermined amount of weights in the bottom of the shaft.

The aforementioned manufacture does not achieve optimum weight distribution in a golf iron head. Because the head is a unitary, solid casting, the upper portion of the head cannot be lightened sufficiently to obtain as low a center of gravity as is desirable to attain maximum loft in the trajectory of a ball struck by the iron. Additionally, weighting the individual irons by loading weights in the shaft to achieve the desired weight locates material in the shaft above the club head. This not only damages the dynamic characteristics of the shaft but the additional weight above the heel of the club head raises the center of gravity of the striking portion of the club and moves it towards the heel of the head, tending to induce a slice.

There has recently been developed a golf iron construction in which the weight distribution of the head is controlled to lower the center of gravity and to insure symmetry about the impact center. This method comprises casting, by the investment process, metal to form a head body which has an internal cavity that extends from the top edge of the head, beneath substantially the entire face of the head. The cavity, which is formed by use of a ceramic insert in the mold, is filled with a low density material such as an epoxy resin and predetermined amounts of weights such as lead shot and the like, are placed in the bottom of the cavity to maintain a low center of gravity and symmetrical weight distribution.

Unfortunately, the manufacturing tolerances in casting of an iron head body with a thin face and subjacent cavity do not permit a high yield of acceptable products. Commonly, the face must be cast with a thickness of approximately 0.05 inch with longitudinal grooves, to enhance the frictional contact with the ball, scored along its exterior surface of a depth of approximately 0.015 to 0.03 inch. The experience with manufacturing iron heads of this type is that approximately 80% of the products are not acceptable because of warping of the thin, grooved face of the head. Accordingly, this manufacturing method does not provide a simple and inexpensive manufacture of the iron head of improved construction.

SUMMARY OF THE INVENTION

A superior golf iron of improved construction has now been developed. The iron comprises a head having a hozel, neck and body dependent thereon with an open cavity formed in the body of the head and extending from one edge thereof across a substantial portion of the face to a first depth therein. There are formed along at least two, opposite cavity edges, faceplate land grooves which are formed to a second depth, lesser than the first depth therein. A sheet metal plate is prepared with a thickness approximately equal to the second depth and with exterior dimensions to seat in the land grooves. The plate bears conventional scored or relieved longitudinal grooves across its outer surface. The plate is seated in the grooves, thereby closing the face to the cavity and is fused about its periphery to the head body to form a head having an anterior cavity open along one edge surface and extending across a substantial portion of the face of the club. The internal cavity is then filled with a low density filler such as epoxy resin and the like. During the filling process, the correct swing weight of the club is imparted by placing, in the bottom of the cavity, a predetermined amount of weights of dense material such as lead and the like. In the preferred method of manufacturing, the internal cavity is filled by placing a minor amount of an epoxy resin in the cavity, then placing the necessary amount of the weights in the form of small particles, e.g., approximately number 40 shot particles and, thereafter, filling the cavity with the epoxy resin. This manufacture insures that the weight particles are entirely surrounded by the epoxy resin. The preferred embodiment of the head has the cavity open at its top edge for filling with the epoxy resin and weights since this reduces the mass of the upper portions of the iron head and thereby lowers its center of gravity.

BRIEF DESCRIPTION OF THE DRAWINGS

The invention will be described by the illustrations of the presently preferred embodiment, of which.

DESCRIPTION OF PREFERRED EMBODIMENTS

Figure 1:
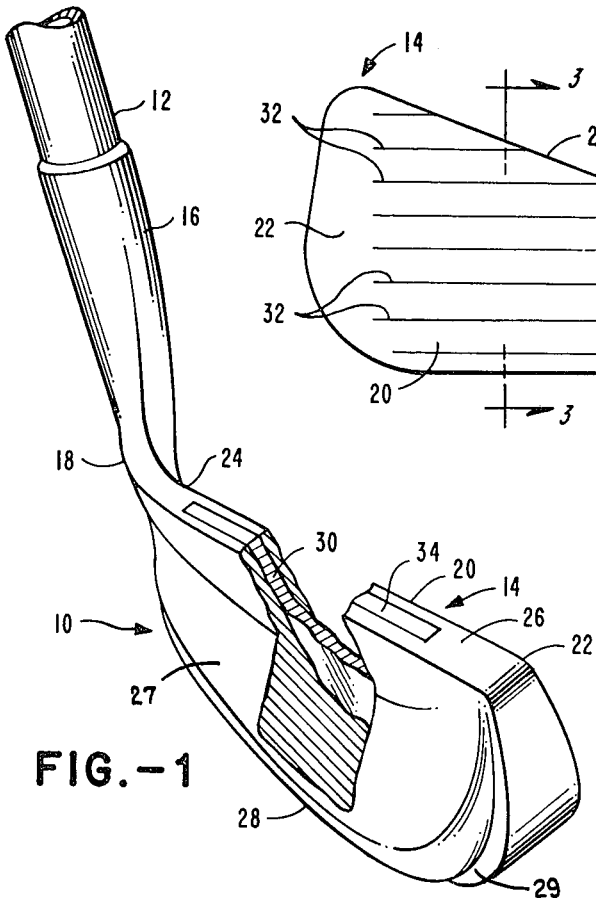
FIG. 1 is a perspective view of a portion of a golf club manufactured by the invention.
Figure 2:
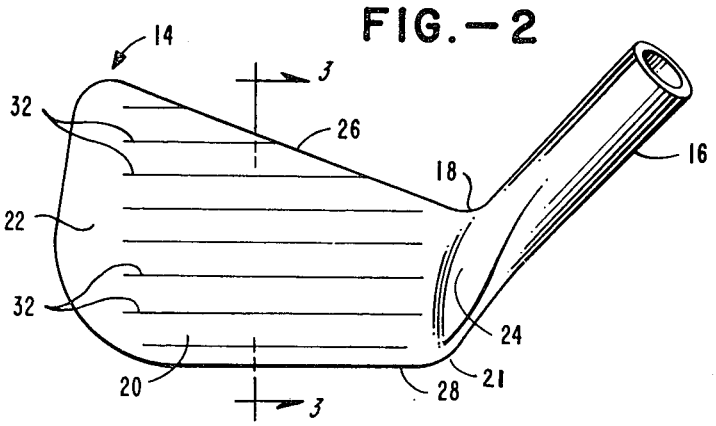
FIG. 2 is a front view of a finished club manufactured in accordance with the invention.

As shown in FIG. 1, the golf club manufactured in accordance with the invention is an iron type with a shaft 12 having its lower end secured to head 14. The head 14 includes a hozel 16 which is generally continuous with the shaft 12, a neck 18 generally continuous with and of reduced diameter to hozel 16, a face 20 presenting a generally flat striking surface, a heel 21, a toe 22 on the opposite end of the head 14 from the hozel 16, a grunkel 24 adjacent to and forming an angle with face 20, a generally flat bottom surface or sole 28 forming an acute angle with face 20 and a cavity 30. The neck 18 is preferably flattened and feathered into the body to provide an unobstructed view of the face 20. As is conventional in the manufacture, the acute angle between face 20 and the bottom surface or sole 28 is determined by the iron number and decreases with increasing number.

Figure 3:
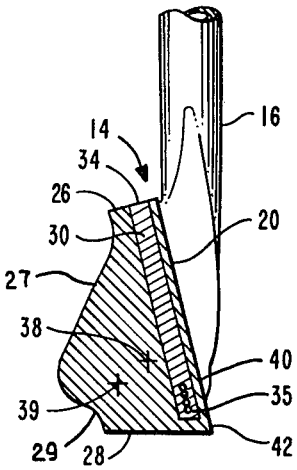
FIG. 3 is a sectional view of the club of FIG. 2 taken along the line 3—3 thereof.

As apparent from FIG. 3, the head of the club is shaped to provide a low center of gravity with the head having a relatively thin top edge 26 and an inclined rear wall 27 to provide a thickness normal to the club face 20 which increases towards the bottom or sole 28. The thickness of sole plate 28 is also reduced by arcuate chamber 29 which is formed along the bottom and toe edges of the head.

The cavity 30 comprises an internal cavity extending from one edge surface, preferrably the top edge 26, of the club subjacent to face 20 and is continuous over a substantial area of face 20. As shown in the preferred embodiment, the cavity 30 is generally rectangular in shape and is parallel to and substantially coextensive with face 20. The cavity is about 2 inches wide and has a thickness from 0.05 to about 0.15 inch, preferrably about 0.01 inch. The internal cavity extends over substantially the entire area of face 20 and terminates at the bottom of the head, approximately 0.1 inch from the bottom surface or sole 28.

There is disposed in the internal cavity 30 a low density filler material 34 which can be a suitable plastic resin such as an epoxy resin which typically has a density from about 1.5 to about 2 grams per cubic centimeter. The resin is introduced into the cavity and permitted to harden therein.

As illustrated in FIG. 3, the cavity 30 contains a predetermined amount of weighted material 35 such as lead shot or powders of similarily high density material. Typically, the lead shot has a density from about 10 grams to about 12 grams per cubic centimeter. This predetermined amount of weighted material is located at the bottom of cavity 30, as illustrated, and the remainder of the cavity is filled with the lower density plastic resin. The cavity 30 and the weighted material 35 effect a lowering of the center of gravity of the head 14 when compared to a conventional one piece, solid form head. The absence of the high density metal material in cavity 30 and its replacement with a lower density material such as an epoxy resin, as well as the positioning of the necessary weighted material 35 for the proper swing weight characteristic within cavity 30 lowers the center of gravity of the club from the point indicated at 38 to that indicated at 39. The general effect of this construction can be to place the center of gravity of the club head beneath the center of percussion 40 between the club and a golf ball.

Figure 4:
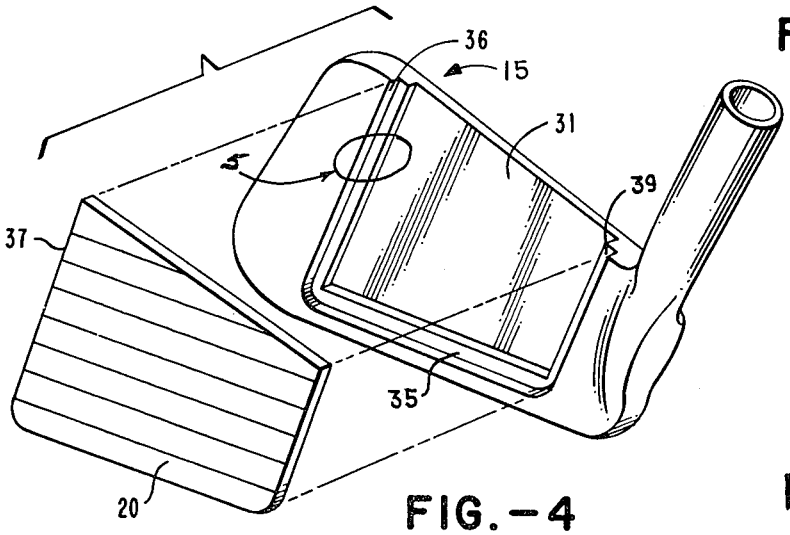
FIG. 4 is an exploded view illustrating the manufacture of the club of the invention.

As previously mentioned, the invention comprises the aforedescribed head for a golf iron. The method of manufacture is illustrated in FIG. 4 where the head 14 can be seen to be formed of a two piece construction; the body 15 and the faceplate 37. Body 15 can be formed by a conventional investment casting process wherein a pattern of the head is molded in a ceramic or similar mold forming material and is then removed by baking or firing of the mold to a high temperature to melt or burn the pattern from the interior of the mold. The metal is then poured into the mold in the conventional fashion, permitted to cool therein and the mold is broken away from the finished part. Typically, stainless steel alloys are used in the casting and provide a head body having a density of about 7.5 to 8.5 grams per cubic centimeter. As thus formed, the body 15 includes a hozel 16 dependent on the body 15 by neck 18. The body is also formed with an open cavity 31 which extends from one edge thereof, preferably from the top edge, across a substantial portion or area of the face of the club and extends to a first depth therein that is generally constant throughout the cavity.

Grooves 36 and 39 are formed along at least two opposite cavity edges. As illustrated, a groove 35 is also formed along the bottom edge of the cavity. If desired, however, the groove 35 could extend to the bottom 28 or sole of the club. These grooves serve as mounting lands for faceplate 37. Grooves 35, 36 and 39 are milled or cut into the peripheral edges of cavity 31 to a second depth, lesser than the depth of cavity 31 about the periphery of this cavity. Typically, the grooves are milled in body 15 to a depth from 0.040 to 0.070, preferably about 0.056 inch.

Figure 5:
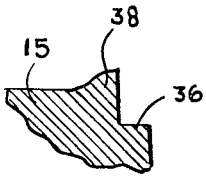
FIG. 5 is an enlarged sectional view of a portion of the club head during its manufacture.

Referring now to FIG. 5, the body 15 is shown with a shoulder 38 that is coextensive with groove 36. Similar shoulders are provided adjacent grooves 35 and 39. These shoulders are cast in the face of body 15 about the periphery of cavity 31 with a width which is from 0.010 to 0.020, preferably about 0.020, inch greater than the width of grooves 35, 36 and 39 and a height above the face of body 15 of about 0.030 inch. After grooves 35, 36 and 39 are milled into the edges of cavity 31 thin shoulders 38 remain on the face to supply metal for the fusion of faceplate 37 to body 15. The oxide surface or crust on these shoulders is removed by polishing or grinding before the faceplate 37 is fused to body 15.

Faceplate 37 is prepared as a metal stamping which has a thickness approximately equal to the depth of grooves 35, 36 and 39 and is of exterior dimensions to seat snugly in the grooved periphery of cavity 31. Typically, the plate will have a thickness from 0.035 to about 0.065 inch. The preferred embodiment has a thickness of 0.05 inch which is seated in land grooves having a depth of about 0.056 inch. When the club head is finished, the surface of body 15 is then polished to the same level as faceplate 37 by removing approximately 0.006 inch thickness of metal therefrom. The exterior surface 20 of face 37 is scored with a plurality of grooves 32 which extend across the face 20, generally parallel to the sole 28 and function to provide increased frictional contact between face 20 and a ball and to reduce the rigidity of face 20. In the preferred embodiment, grooves 32 terminate a slight distance, about 0.030 inch, inboard of the edges of faceplate 17 to remove these grooves from the area of the fused seam between body 15 and faceplate 37. These grooves have a surface depth from 0.015 to about 0.03, preferably from 0.02 to 0.025 inch.

The plate 37 is placed in the peripheral seat defined by grooves 35, 36 and 39 and is secured to the body 14 by suitable means, preferably by electron fusion wherein the head and plate are placed in a vacuum chamber and an electron beam is passed along the seam between plate 37 and body 14 to fuse these separate pieces in a fluxless fusion step. This fusion secures the plate 37 to the head 14 without producing any significant bead on the surface 20 of the club. Following the fusion of plate 37 to body 15, the face of th club is polished and any bead or residue of shoulders such as 38 on the hitting surface is removed therefrom by grinding and polishing. This polishing also reduces the surface of body 15 to the same level as the surface 20 of faceplate 37.

The swing weight designation for the particular club is determined and the cavity 30 formed between faceplate 37 and body 15 is filled with a plastics resin and a predetermined amount of weighted material. The cavity is filled by placing a small amount of the plastics resin, typically an epoxide resin, into the cavity to fill the cavity to a depth of about ¼ inch. Thereafter a predetermined amount of weighted material, e.g., No. 40 lead shot, is placed into the cavity and distributed across the bottom thereof. These particles are immersed in the epoxy resin within the cavity and the cavity is then filled to the top surface 26 with the epoxy resin. The resin is then cured by holding the head 14 at the requisite curing temperature and for the requisite period of time. Typically, resins employed can have a curing time of from about 10 minutes to about several hours at temperatures from ambient to about 150° F.

The body portion 15 can be cast from a suitable metal, preferably from 17-4-PH stainless steel in an investment casting process. The plate 37 can be formed of similar material however, it is preferred to employ a more malleable material which can be readily machined and formed in a metal stamping step. Accordingly, it is preferred to employ 17-7-PH stainless steel for construction of the faceplate 37.

The invention has been described by reference to the illustrated and presently preferred embodiment. It is not intended that the invention be unduly limited by this description of the preferred embodiment. Instead, it is intended that the invention be defined by the steps and means, and their obvious equivalents, set forth in the following claims.

What is claimed is:

1. A golf club comprising a head of the numbered category iron type having an improved weight distribution below its center of precussion with a ball which comprises:

a head blank having a hosel, neck and body dependent thereof of the shape and size generally characteristic of an iron head of numbered catagory and bearing, in the face of said body, a cavity extending from at least one edge of said body across a substantial portion of said face and below said center of precussion;

a sheet metal face plate extending across the face dimensions of said cavity and mounted flush with the surface of said head and secured thereto by fusion along its periphery to said head body, thereby defining a homogeneous head blank having an interior cavity open along the top edge of said head and extending across a substantial distance of said face to below said center of precussion;

a predetermined amount of high density weighted material in the bottom of said cavity below said center of percussion to impart the desired swing weight to said blank; and a low density filler filling the remainder of said cavity.

2. The club of claim 1 wherein said cavity extends across the entire face of said head blank.

3. The club of claim 2 wherin said low density material is an epoxy resin.

4. The club head of claim 1 wherein said sheet metal face plate has a thickness from 0.035 to about 0.065 inch.

5. The club of claim 4 wherein said head is a casting of a first metal and said face plate is formed of a malleable sheet metal.

6. The club of claim 5 wherein said sheet metal plate bears a plurality of longitudinal grooves across its face at a depth of from 0.015 to about 0.03 inch.

7. The club of claim 1 wherein said head has a thickness, normal to said face of increasing dimension from the top to bottom edge thereof.

8. The club of claim 1 wherein said internal cavity has a substantially uniform thickness from 0.05 to about 0.15 inch and extends from the top edge to within about 0.1 inch from the bottom edge of said head.

* * * * *